US009241540B2

(12) United States Patent
Orozco

(10) Patent No.: US 9,241,540 B2
(45) Date of Patent: Jan. 26, 2016

(54) DEVICE TO KEEP THE SHAPE OF FOOTWEAR WITH LENGTH ADJUSTMENT SYSTEM

(76) Inventor: Ricardo Labiaga Orozco, Guanajuato (MX)

( * ) Notice: Subject to any disclaimer, the term of this patent is extended or adjusted under 35 U.S.C. 154(b) by 579 days.

(21) Appl. No.: 13/590,441

(22) Filed: Aug. 21, 2012

(65) Prior Publication Data

US 2013/0334264 A1 Dec. 19, 2013

(51) Int. Cl.
*A43D 19/00* (2006.01)
*A43D 3/14* (2006.01)

(52) U.S. Cl.
CPC ..... *A43D 3/1475* (2013.01)

(58) Field of Classification Search
CPC . A43D 3/1475; A43D 3/1483; A43D 3/1433; A43D 3/1466
USPC ..... 12/115.8, 116.2, 116.6, 117.4, 135 A
See application file for complete search history.

(56) References Cited

U.S. PATENT DOCUMENTS

| | | | | | |
|---|---|---|---|---|---|
| 1,290,879 | A | * | 1/1919 | Baruch | 12/115.6 |
| 2,010,146 | A | * | 8/1935 | Garson | 12/115.2 |
| 2,438,748 | A | * | 3/1948 | Greenberg | 12/128 R |
| 3,263,252 | A | * | 8/1966 | Johnson | 12/116.6 |
| 3,435,475 | A | * | 4/1969 | Bisk | 12/117.4 |
| 4,577,360 | A | * | 3/1986 | Swenson | 12/115.6 |

FOREIGN PATENT DOCUMENTS

| | | | |
|---|---|---|---|
| DE | 1064848 | * | 9/1959 |
| EP | 0332482 | * | 9/1989 |
| FR | 40007 | * | 12/1931 |
| GB | 242442 | * | 8/1925 |
| GB | 372096 | * | 2/1932 |

* cited by examiner

*Primary Examiner* — Ted Kavanaugh
(74) *Attorney, Agent, or Firm* — Hoglund & Pamias, PSC; Roberto J. Rios

(57) ABSTRACT

A device for maintaining the shape of footwear, both at the tip of a shoe as in the stiffener through a tension force against the tip and stiffener of the shoe, the same caused by the device snap-fitting and its natural tensioning element curved, is provided. The device comprises two separate pieces and detachably bonded there between by means of a recess, interlocking means and recesses and cavities that are snapping correspondingly.

5 Claims, 3 Drawing Sheets

DEVICE TO KEEP THE SHAPE OF FOOTWEAR WITH LENGTH ADJUSTMENT SYSTEM

BACKGROUND AND FIELD OF THE INVENTION

This utility model relates to the field of footwear, more specifically, to supporting tools that allow to keep the shape of footwear when not in use, a process generally known as shoe-fitting.

It has been a constant development in the footwear the tools to maintain the shape of the shoes, for example, the utility model registration No. ES 1039467U which is aimed with a shoe-tree to prevent deformation of the footwear. It has a built-in piece that includes a suitable container for an antiseptic. This part has a bellows shape not allowing changes by the user in terms of its length.

The utility model registration No. ES 10419654 describes a shoe-tree for footwear which objective is to prevent shoe deformation, and provide for perfume and/or antiseptic powders for footwear. Comprises a front part determined by a domed body and an elongated back part. The shoe-tree has a receptacle or container for an antiseptic product with bellows structure. The novel part is in the fins shape means to attach the container to the shoe-tree.

It is clear from the foregoing the need for a device to maintain the shape of footwear that contains a system adjustable in length, to prevent the user has to rely on a shoe-fitting device for each shoe size.

There is also the need to replace quickly and reliably any part of the device without the need to acquire the entire device.

This model is aimed not only to prevent deformation, but to take care of maintaining the shape of the shoe, i.e. maintaining the confined space in the footwear for the metatarsal-phalanges joints shown in FIG. 1, as well as the perimeter of retention (A) and the lower perimeter (B) shown in FIG. 3, present parts in any footwear.

An important difference of the present utility model with respect to Spanish utility models is that the latter are of one piece. The fact that the present model is in two parts provides the advantage of having a device variable in length which could not be achieved by using a single piece design. In addition, the device of the present invention has only two parts which can be assembled quickly and easily and combinations of elements of identical or similar devices may be used.

DETAILED DESCRIPTION OF THE INVENTION

Figure 1:
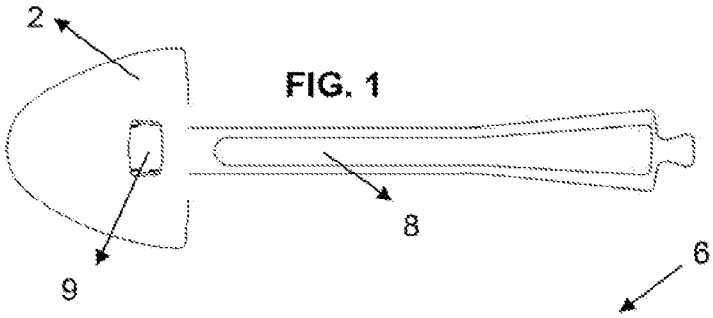
FIG. 1 is an upper view of the novel assembled device.

In accordance with FIGS. 1 to 11, there is an illustrating mode and exemplary of the present invention showing that the same refers to a device comprised by two pieces, to maintain the shape of the shoes when these are not in use, with a length adjustment system. The device comprises (see FIGS. 1 and 2) a body (1) to maintain the shape of the shoes tip. In the central and upper part of the upper face (2) of the body (1) is a recess or rabbet (4) with interlocking means (5) (FIGS. 3 to 7). The interlocking means (5) is attached to the ends of the side recess or rabbet forming a single piece.

The adjustment system basically includes a tensioning element (6), which is independent of the body (1) of the device. Tensioning element has an end back portion (7), an intermediate portion (8) and a front end portion (9). In its front portion (9) at least two stops are located (10) equidistant from other, and in accordance with the size of the device to maintain the shape of the footwear. These outbound stops form cavities (11) where interlocking means are located (5). The portion of back end (7) has a wider shape that the end portion (9) and includes reinforcing element (7A) because it has the function of tensioning the stiffener of the shoe.

Figure 2:
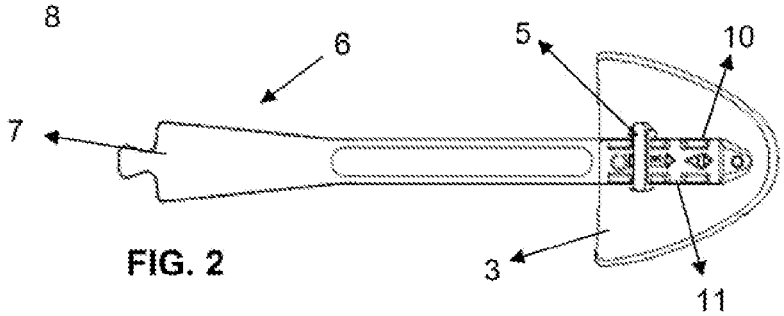
FIG. 2 is a lower view of the novel assembled device.
Figure 3:
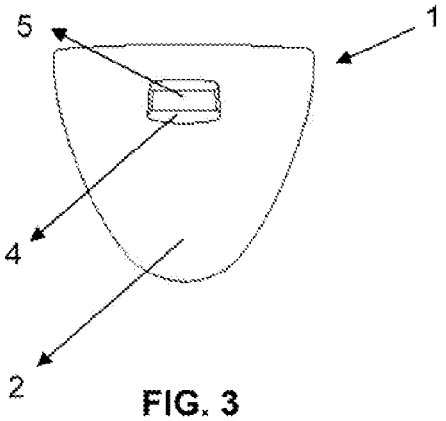
FIG. 3 is an upper view of the body of the novel device.
Figure 4:
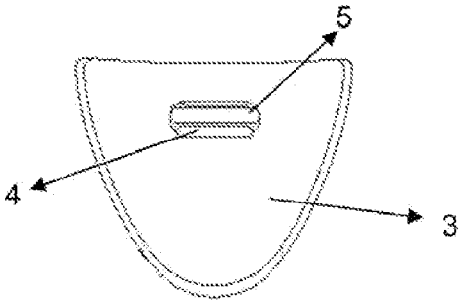
FIG. 4 is a lower view of the body of FIG. 1.
Figure 5:
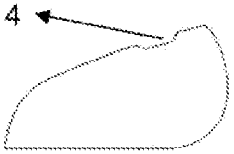
FIG. 5 is a left side view of the body, being the right side view a mirror image thereof.
Figure 6:
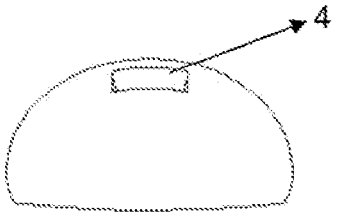
FIG. 6 is a front elevation view which displays the recess or rabbet where the tensioning element in the body is introduced.
Figure 7:
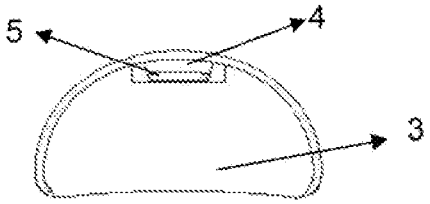
FIG. 7 is a back elevation view of the device body showing that the internal face is completely hollow.
Figure 8:
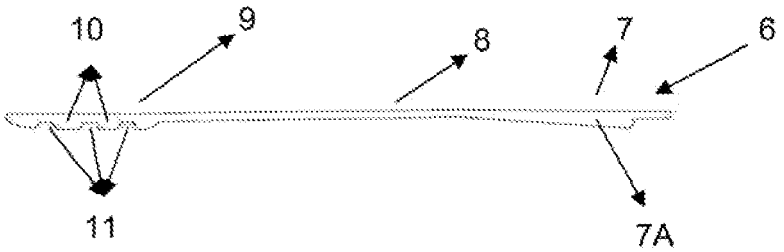
FIG. 8 is a left side view of the device tensioning element, being the right side view a mirror image thereof.
Figure 9:
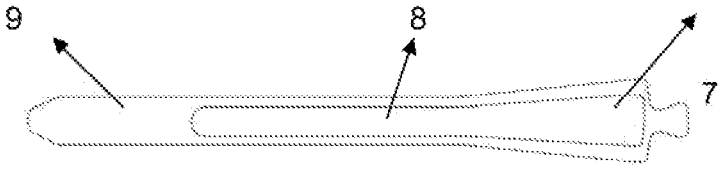
FIG. 9 is an upper view of the tensioning element.
Figure 10:
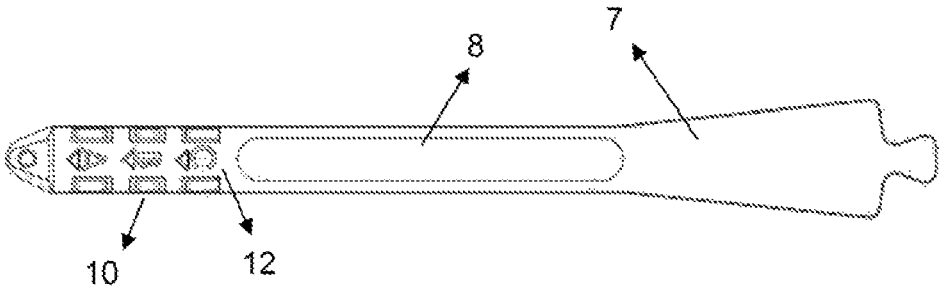
FIG. 10 is a bottom view of the tensioning element showing the interlocking means as stoppers and cavities.
Figure 11:
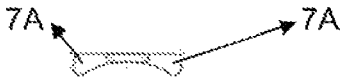
FIG. 11 is a back view of the tensioning element.

As shown in FIGS. 1 and 2, the tensioning element (6) is inserted through the top of the internal face (3), with stops (10) facing toward the bottom of this face (3). The stops are slipped by pressure within the recess (4) locking with the interlocking element (5), thus setting the total length of the fitting device.

It is clear that the total length of the device will be greater than the length of the footwear, the difference in length is assumed by the shoe-fitting device flexing the tensioning element. This flexing is the force that will push the body (1) against the tip of the shoe and the end back portion (7) against the stiffener, thus restoring the leather to a stretching condition, which restores the original lines of the footwear, and reaching with this form is most similar to the original of the same.

The device the present invention has been illustrated in an exemplary embodiment represented by a body configured for men's shoe-fitting; but the principles and constituent parts thereof are equivalent for a lady footwear and for boys/girls footwear as well. Pieces between these devices can be exchanged in a given time without losing the functionality thereof. For example, the device tensioning element used for men footwear may be exchanged with that used for ladies footwear and the same for the girls and boys footwear, or even for tennis and other types of footwear provided that the shoe-fitting device basically comprises a tensioning element (6) that includes stops (10) and cavities (11) and a main body (1) that comprises a recess (4) and an interlocking element (5). The configuration of the main body and of the tensioning element may vary, as is evident to a person with average knowledge in the art and it is necessary that such evident variations are within the scope of the invention, limited only by the claims appended.

The invention claimed is:

1. A device for maintaining the shape of footwear with a length adjustment system, said device comprising:

a device body (1) having a recess (4) located in a central and upper part of an upper face (2) of said device body (1), said recess comprising a first pass-through opening having a U-shaped interlocking means (5) within; and a tensioning element (8), independent of said device body, comprising a back end portion (7), an intermediate portion (8) and a front end portion (9), wherein said front end portion (9) comprises at least two stops (10) forming cavities (11) between said at least two stops (10) and the end back portion (7) includes reinforcing elements (7A) and has a shape wider than the shape of said front end portion (9).

2. The device according to claim 1, wherein said U-shaped interlocking means (5) protrudes downwardly from a lower face (3) of said device body (1) forming a second pass-through opening perpendicular to said first pass-through opening.

3. The device according to claim 2, wherein the interlocking means (5) is positioned within one of said cavities (11) when said tensioning element (8) is inserted through said second pass-through opening.

4. The device according to claim 1, wherein said at least two stops (10) are equidistant from each other and the distance is selected according to the size of the device to maintain the shape of the footwear.

5. The device according to claim 1, wherein the front end portion (9) of the tensioning element (8) stops against a shoe stiffener.

* * * * *